United States Patent [19]

Minami et al.

[11] Patent Number: 4,502,924

[45] Date of Patent: Mar. 5, 1985

[54] METHOD FOR REPAIRING A MOLD FOR CONTINUOUS CASTING OF STEEL

[75] Inventors: Kenji Minami; Yoshimasa Kawata; Tetsuji Ushio; Hoshiro Tani; Kazuhisa Mitani, all of Kitakyushu, Japan

[73] Assignees: Nippon Steel Corporation, Tokyo; Mishima Kosan Company, Limited, Kitakyushu, both of Japan

[21] Appl. No.: 412,973

[22] Filed: Aug. 27, 1982

[30] Foreign Application Priority Data

Sep. 1, 1981 [JP] Japan ..... 56-138081

[51] Int. Cl.[3] ..... C25D 5/40

[52] U.S. Cl. ..... 204/16; 204/32.1

[58] Field of Search ..... 204/16, 32 R, 32.1

[56] References Cited

U.S. PATENT DOCUMENTS

| | | | |
|---|---|---|---|
| 2,965,551 | 12/1960 | Richaud | 204/32 R |
| 3,963,588 | 6/1976 | Glenn | 204/16 |
| 4,037,646 | 7/1977 | Hara et al. | 164/418 |
| 4,055,472 | 10/1977 | Freshcorn | 204/32 R |
| 4,144,993 | 3/1979 | Ushio | 228/107 |

FOREIGN PATENT DOCUMENTS

| | | | |
|---|---|---|---|
| 617689 | of 0000 | United Kingdom | 204/16 |
| 618322 | 2/1949 | United Kingdom | 204/16 |
| 825928 | 12/1959 | United Kingdom | 204/16 |
| 1299850 | 12/1972 | United Kingdom | 204/16 |
| 1496623 | 12/1977 | United Kingdom | 204/16 |
| 1534120 | 11/1978 | United Kingdom | 204/16 |

OTHER PUBLICATIONS

ASTM B 558-79 Standard Practice for Preparation of Nickel Alloys for Electroplating.

ASTM B 343-79 Standard Practice for Preparation of Nickel for Electroplating with Nickel.

Modern Electroplating, Wiley-Interscience, Third Edition, 1974, pp. 583-587.

Graham, *Electroplating Engineering Handbook,* 3rd Edition, pp. 184-186.

*Primary Examiner*—Thomas Tufariello

*Attorney, Agent, or Firm*—Wenderoth, Lind & Ponack

[57] ABSTRACT

In case that the surface of a mold for continuous casting of steel made of copper or copper alloy having at least partially nickel or nickel-base alloy plated thereon is injured, said surface is abraded without complete removal of said plated layer, the resulting exposed surface is dipped with concentrated strong acid for activation, and thereafter it is repaired by plating nickel or nickel-base alloy thereon.

1 Claim, 4 Drawing Figures

METHOD FOR REPAIRING A MOLD FOR CONTINUOUS CASTING OF STEEL

BACKGROUND OF THE INVENTION

This invention relates to a method for repairing a mold for continuous casting of steel.

Generally speaking, the mold for continuous casting is made of copper or copper-alloy body with a nickel or nickel-base alloy layer plated thereon. Sometimes a chromium layer may additionally be plated on said plated layer. When the surface plated layer is worn and scratched in use, it is usually subjected to a repairing operation.

The conventional way of repairing was to completely abrade and remove all the nickel or nickel-base alloy layer from the surface and thereafter apply a new surface thereon.

FIG. 1 shows an example where a nickel or nickel-base alloy layer 2 and a chromium layer 3 have been applied to the surface of a mold body 1 made of copper or copper alloy. When it is desired to repair it, the abrading operation is made to the extent of a plane A—A of FIG. 1 to remove the entire plated layer and thereafter form a new plated layer thereon. It is because there has been an insufficient adhesion problem between the two metals of the same kind plated on each other and a degradation problem in use of the nickel or nickel-base alloy plated layer.

The thickness of the nickel or nickel-base alloy plated layer applied to the lower surface of the mold body tends to become greater nowadays as the speed of the continuous casting becomes faster. The abrading of the surface of a mold has been conducted independent of the degradation of its plated layer and, therefore, it is obviously undesirable, from the view point of the mold costs and the material savings, to remove all parts of the layer including a part which can fully be reused.

Under the circumstances, the inventors have made attempts not to remove all the expensive nickel or nickel-base alloy layer but to leave a part of it on the mold body, and to apply thereon a new nickel or nickel-base alloy layer according to the known method. This is exemplified in FIG. 1 where the abrading operation is conducted to the line B—B of the nickel layer 2, on which a new nickel layer is plated. However, the adhesion power by shearing between the basic old plated layer and the newly provided layer is 5 to 25 kg/mm$^2$, which shows considerable fluctuation. It is thus clear that the molds repaired according to the above include one which can never be practically used at such high temperature and under such severe conditions as applied to the mold for continuous casting of steel. According to the inventors' study, the adhesion power between the new and old plated layers in the mold for continuous casting of steel necessitates at least 20 kg/mm$^2$ and the fluctuation in this case must be $\sigma_n \leqq 3.0$ where $\sigma_n$ is the standard deviation. This means that so long as the known method is followed, there is a tendency that many materials may be dipped, which must be improved.

BRIEF SUMMARY OF THE INVENTION

It is an object of this invention to provide a method for repairing a mold for continuous casting of steel in which a surface plated layer can be adhered tightly without any substantial loss of materials.

It is another object of this invention to provide a mold for continuous casting of steel.

These objects of this invention can be accomplished, in the repair of a mold for continuous casting of steel made of copper or copper alloy body having nickel or nickel-base alloy layer plated on at least a part of its surface, by conducting the surface abrading operation without complete removal of the nickel or nickel-base alloy plated layer, subjecting the resulting abraded surface to an acid-dipping operation with strong acid to activate said surface and then providing a new nickel or nickel-base alloy plated layer thereon.

In this case, a strong acid having acid concentration of at least 40 wt.% may be used. The strong acid may be nitric acid having a concentration of 60 wt.% or more. Alternatively, the strong acid may be one containing at least 50 vol.% of nitric acid of at least 60 wt.% concentration, the rest being at least one member selected from the group consisting of sulfuric acid, hydrochloric acid, hydrofluoric acid, phosphoric acid and aqueous hydrogen peroxide.

According to this invention, there is further provided a mold for continuous casting made of copper or copper alloy, having two or more layers of nickel or nickel-base alloy on at least a part of its surface.

DESCRIPTION OF THE PREFERRED EMBODIMENT

Figure 1:
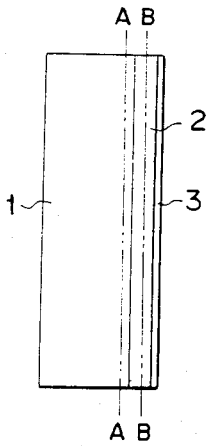
FIGS. 1 to 4 are schematic views of examples of the structure of the body and its surface plated layer of molds for continuous casting of steel, to which this invention may be applied respectively.

FIG. 1 shows an example of the structure wherein a layer 2 of nickel or nickel-base alloy of uniform thickness is provided over the entire surface of the mold body 1 made of copper or copper alloy and a chromium layer 3 is also provided in the outermost layer.

Figure 2:
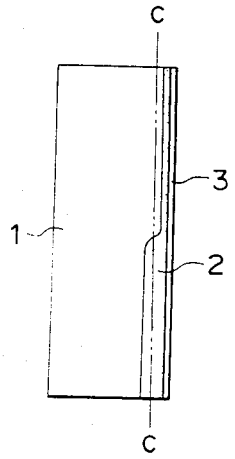

FIG. 2 shows an example of the structure wherein a lower part of the nickel or nickel-base alloy layer 2 has a stepwise increased thickness.

Figure 3:
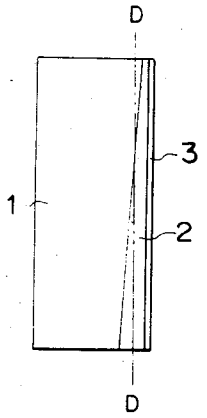

FIG. 3 shows an example of the structure wherein the nickel or nickel-base alloy layer 2 becomes gradually thicker downwardly.

Figure 4:
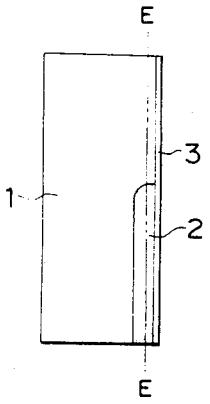

FIG. 4 shows an example of the structure wherein the nickel or nickel-base alloy layer 2 is provided only on the lower half of the mold.

The work nickel-base alloy herein used indicates an alloy containing nickel as a main component and at least one element such as Co, Fe, Mn, Cr, W, C, B and P, etc.

Generally in a mold for continuous casting of steel, a sufficient heat removal effect is required at its surface of contact with molten steel. When a solidified shell is formed at the meniscus in the upper part of a mold and then passed through the mold, it is designed such that the thickness of the shell can stand the static pressure of the molten steel. One of the factors which have effect upon the life of a mold having above function is the wear or abrasion between the solidified shell and the lower part of the mold. Further, when the solidified shell is brought into direct contact with a mold body or copper or copper alloy, there occur minute cracks called "star crack" on the surface of the cast piece which will cause the lowering of yield of the cast piece. Therefore, the lower part of a mold is in many cases provided with a thicker cover or layer than the upper part of it.

In the practice of this invention, as set forth above, when a mold for continuous casting of steel provided on the surface of its body with a nickel or nickel-base alloy layer 2 and, if desired, with a chromium layer 3 on said layer 2 is to be repaired, only the injured part is abraded, such as to a plane of B—B in FIG. 1, and the resulting abraded surface is treated with strong acid for activation and then provided with a new nickel or nickel-base alloy plated layer.

As shown in FIGS. 2 to 4, in case the nickel or nickel-base alloy layer 2 positioned in the lower part of a mold is thicker than that in the upper part, the abrading operation is effected to the planes, C—C, D—D and E—E, respectively and the resulting abraded surface is plated with the nickel or nickel-base alloy layer 2 over its entire surface or over its lower surface only. The plating operation used in this invention may be electroplating or non-electroplating.

Some preferred examples of this invention are shown with comparative examples below.

Samples No. 1, No. 3 and No. 7 are comparative examples while Samples No. 2, No. 4, No. 5 and No. 6 are examples of this invention.

In all cases, the abrading is carried out to the extent of B—B, and the roughness of the exposed surface is kept at 0.006 mm or less.

The exposed surface is uniformly prepared to be rough by "wet-honing" with hones of particle size #20 in alkali solution. Next, said exposed surface is degreased with (1) a solvent (toluene+ethanol) and then with (2) an alkali (concentration 100 g/l, liquid temperature 60° C.) and dipped with (3) acid (HCl, 10 wt.%).

TABLE 1

| | | Conditions of Electroplating | | | | |
|---|---|---|---|---|---|---|
| | | | Conditions of electroplating | | | |
| Sample No. | Material | Pretreatment | Electric current density | Liquid components | Liquid temp. | pH |
| No. 1 (Prior Art) | Cu | (1) Solvent degreasing (2) Alkali degreasing (3) Dipping with dilute HCl (4) No dipping with strong acid | 7 A/dm$^2$ | Nickel sulfaminate 400 g/l Nickel chloride 5 g/l Boric acid 40 g/l Sodium lauryl | 60° C. | 4.0 |
| No. 2 | Ni | (1) degreasing (2) Alkali degreasing (3) Dipping with dilute HCl (4) Dipping with conc. strong acid concentration: 63 wt. % composition: $HNO_3$ (50 vol. %) + $H_2SO_4$ (50 vol. %) | Solvent | 0.1 g/l | sulfate | |
| No. 3 | Ni | (1) Solvent degreasing (2) Alkali degreasing (3) Dipping with dilute HCl (4) Dipping with conc. strong acid concentration: 30 wt. % composition: $HNO_3$ (50 vol. %) + $H_2SO_4$ (50 vol. %) | | | | |
| No. 4 | Ni | (1) Solvent degreasing (2) Alkali degreasing (3) Dipping with dilute HCl (4) Dipping with conc. strong acid concentration: 45 wt. % composition: $HNO_3$ (50 vol. %) + $H_2SO_4$ (50 vol. %) | | | | |
| No. 5 | Ni + 7% Fe | (1) Solvent degreasing (2) Alkali degreasing (3) Dipping with | | Nickel sulfaminate 400 g/l Iron sulfaminate | | |

TABLE 1-continued

| Sample No. | Material | Pretreatment | Conditions of Electroplating: Electric current density | Conditions of electroplating: Liquid components | Liquid temp. | pH |
|---|---|---|---|---|---|---|
| | | dilute HCl (4) Dipping with strong acid concentration: 45 wt. % composition: $HNO_3$ (50 vol. %) + $H_2SO_4$ (50 vol. %) | | 1 g/l Nickel chloride 5 g/l Boric acid 40 g/l Sodium lauryl sulfate 0.1 g/l | | |
| No. 6 | Ni + 7% Fe | (1) Solvent degreasing (2) Alkali degreasing (3) Dipping with dilute HCl (4) Dipping with conc. strong acid concentration: 40 wt. % composition: $HNO_3$ (50 vol. %) + $H_2SO_4$ (50 vol. %) | | | | |
| No. 7 | Ni + 7% Fe | (1) Solvent degreasing (2) Alkali degreasing (3) Dipping with dilute HCl (4) Dipping with conc. strong acid concentration: 35 wt. % composition: $HNO_3$ (50 vol. %) + $H_2SO_4$ (50 vol. %) | | | | |

Note:
The "conc. strong acid" in the above list means "concentrated strong acid".

The "concentrated strong acid" used in this invention means one having its acid concentration of at least 40 wt.%. Its composition may be nitric acid only (its concentration: 60 wt.% or more), or may consist of at least 50 vol.% of nitric acid (its concentration: 60 wt.% or more) and the rest one member or more selected from sulfuric acid, hydrochloric acid, hydrofluoric acid, phosphoric acid and aqueous hydrogen peroxide.

The test results of the adhesive power by shearing are shown.

TABLE 2 unit: $kg/mm^2$

| Sample No. | Material | Normal temp. | 100° C. × 8H | 200° C. × 8H | 300° C. × 8H | 400° C. × 8H | 500° C. × 8H |
|---|---|---|---|---|---|---|---|
| No. 1 | Cu | 20.1 | 21.2 | 21.8 | 21.8 | 17.6 | 8.4 |
| No. 2 | Ni | 39.2 | 40.9 | 41.6 | 40.1 | 33.9 | 32.5 |
| No. 3 | Ni | 29.4 | 31.0 | 40.9 | 34.9 | 29.9 | 21.6 |
| No. 4 | Ni | 38.8 | 35.7 | 38.6 | 38.3 | 30.2 | 19.7 |
| No. 5 | Ni | 38.5 | 38.7 | 38.7 | 36.9 | 31.6 | 22.4 |
| No. 6 | Ni + 7% Fe | 35.7 | 35.3 | 36.8 | 36.2 | 30.7 | 20.5 |
| No. 7 | Ni + 7% Fe | 28.9 | 29.5 | 36.4 | 35.5 | 29.2 | 18.9 |

Note:
In Table 2, the other test values than those of Normal temperature were obtained, for example, in case of 100° C. × 8H, by elevating up to 100° C., preserving at 100° C. for 8 hours and then air-cooling to Normal temperature for the test.

The fluctuation of the adhesive power with respect to the samples 2 to 7 after dipping with acid is shown in Table 3.

TABLE 3

| Sample No. | Item | Normal temp. | 100° C. | 200° C. | 300° C. | 400° C. | 500° C. |
|---|---|---|---|---|---|---|---|
| No. 2 | $\sigma_n$ | 1.4 | 0.6 | 1.0 | 0.8 | 0.8 | 1.3 |
| No. 3 | $\sigma_n$ | 4.5 | 3.4 | 1.0 | 1.4 | 1.5 | 2.5 |
| No. 4 | $\sigma_n$ | 2.2 | 0.6 | 0.9 | 0.4 | 1.1 | 2.3 |
| No. 5 | $\sigma_n$ | 2.5 | 0.9 | 1.0 | 0.6 | 1.0 | 2.4 |
| No. 6 | $\sigma_n$ | 2.9 | 1.4 | 1.0 | 0.9 | 1.2 | 2.3 |

TABLE 3-continued

| Sample No. | Item | Normal temp. | 100° C. | 200° C. | 300° C. | 400° C. | 500° C. |
|---|---|---|---|---|---|---|---|
| No. 7 | $\sigma_n$ | 4.8 | 3.1 | 1.1 | 1.6 | 1.8 | 2.4 |

Note 1:
The values of fluctuation in cases of 100° C., 200° C., 300° C., 400° C., and 500° C. in Table 3 were obtained by elevating up to the corresponding temperature, preserving at said temperature for 8 hours and then air-cooling to Normal temperature for the fluctuation test.
Note 2:
The fluctuation at Normal temperature:

$\sigma(\text{No. 2}) \approx \frac{1}{1.5} \times \sigma(\text{No. 4})$, $\frac{1}{1.8} \times \sigma(\text{No. 5})$, $\frac{1}{2.1} \times \sigma(\text{No. 6})$, $\frac{1}{3.2} \times \sigma(\text{No. 3})$, or $\frac{1}{3.4} \times \sigma(\text{No. 7})$.

It is clear from this that the value of the adhesive power by shearing between the nickel and the nickel-base alloy is affected largely by the conditions of the exposed surface on which the plating is conducted for repair, and that the excellent results can be given in case the treatments are conducted according to this invention, that is, in the samples Nos. 2, 4, 5 and 6. In the practice of this invention, the passivated film on the abraded nickel or nickel-base alloy surface is treated with concentrated strong acid such as nitric acid of at least 60 wt.% concentration. The adhesive power of the nickel or nickel-base alloy plated layer applied to the activated exposed surface shows about twice the value of the conventional sample No. 1 with respect to the temperature range between the normal temperature and 500° C. Also as compared with other comparative examples (samples No. 3 and No. 7), said adhesive power is far greater than those of samples No. 3 and No. 7 and Normal temperature, and its fluctuation is also smaller than said samples.

As set forth hereinbefore, the present invention will enable the art to obviate unnecessary abrading operation with respect to the expensive nickel or nickel-base alloy plated layer and yet to provide tight adhesion between the new and old plated layers with few fluctuation, which increase the life of the cover and of the mold material to a great extent. The present invention can thus provide an extremely useful method for repairing a mold for continuous casting of steel.

The above description refers only to the preferred embodiments of the invention and thus the present invention is not limited thereto. Variations and modifications can be made without departing from the spirit of the invention, which can be included in the claims as follows.

I claim:

1. A method for repairing a mold used for continuous casting of steel with respect to its nickel or nickel-base alloy plated layer wherein the nickel or nickel-base alloy plated layer have been provided on at least a part of the surface of the mold which is made of copper or copper alloy, which comprises abrading the surface without completely removing said nickel or nickel-base alloy plated layer, subjecting the abraded exposed surface to a dipping treatment with concentrated strong acid to activate the same, and thereafter providing a nickel or nickel-base alloy layer thereon, said concentrated strong acid being of at least 40 wt. % concentration, and being either nitric acid only of at least 60 wt.% concentration or a mixture of at least 50 vol.% of said nitric acid and at least one member selected from sulfuric acid, hydrochloric acid and hydrofluoric acid.

* * * * *